US006808248B1

(12) United States Patent
Brugu et al.

(10) Patent No.: US 6,808,248 B1
(45) Date of Patent: Oct. 26, 2004

(54) POSITION MEASUREMENT SYSTEM AND METHOD

(75) Inventors: Joaquim Brugu, Barcelona (ES); Lluis Hierro, Barcelona (ES); Jesus Garcia, Barcelona (ES); Marti Rius, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/424,830

(22) Filed: Apr. 29, 2003

(51) Int. Cl.[7] ..... B41J 23/00; B41J 29/38
(52) U.S. Cl. ..... 347/37; 347/19
(58) Field of Search ..... 347/19, 20, 37

(56) References Cited

U.S. PATENT DOCUMENTS

2003/0035020 A1 * 2/2003 Menendez et al. ..... 347/37

* cited by examiner

*Primary Examiner*—Stephen D. Meier
*Assistant Examiner*—Alfred Dudding
(74) *Attorney, Agent, or Firm*—Foley & Lardner LLP

(57) ABSTRACT

A hard copy device having a carriage arranged to support a printhead and to reciprocate across a scan axis, the device being arranged to determine the position of at least a part of the printhead along the scan axis, compensating for carriage rotation about the an axis orthogonal to the scan axis, by interpolating or extrapolating from carriage position information derived from first and second codestrips traversing the scan axis and spaced apart in a direction orthogonal to the scan axis.

23 Claims, 4 Drawing Sheets

POSITION MEASUREMENT SYSTEM AND METHOD

FIELD OF THE INVENTION

The present invention relates generally to a position measurement system, particularly, although not exclusively, to a method and apparatus for determining the position of scanning printer carriages in inkjet printer devices.

BACKGROUND OF THE INVENTION

Inkjet printer devices generally incorporate one or more inkjet cartridges, often called "pens", which shoot drops of ink onto a page or sheet of print media. For instance, two earlier thermal ink ejection mechanisms are shown in U.S. Pat. Nos. 5,278,584 and 4,683,481, both assigned to the present assignee, Hewlett-Packard Company. The pens are usually mounted on a carriage, which is arranged to scan across a slider rod that traverses a print zone, in which a sheet of print media may be located. As the carriage traverses the print zone, the pens print a series of individual drops of ink on the print media forming a band or "swath" of an image, such as a picture, chart or text. The print media is subsequently moved relative to the carriage, so that a further swath may be printed adjacent to the earlier swath. By a repetition of this process, a complete printed page may be produced in an incremental manner.

In order to generate high quality printed output, it is necessary that the ink drops from the individual pens are accurately applied to the print media. This is made possible by accurately measuring the position of the carriage as it traverses the print media. This is generally achieved using an encoder strip or codestrip, which is arranged parallel to the scan direction of the carriage. Such a codestrip is usually made from a plastics material such as Mylar™, upon which a series of graduations or marks are recorded. The graduations, which may be recorded using a laser plotter, give rise to local variations in the properties (such as optical properties) of the codestrip. An optical sensor mounted on the carriage, may be used to sense the optical variations in the codestrip as the carriage moves relative to it. The output of the sensor may be used by a microprocessor associated with the printer device to generate position and speed information relating to the carriage.

However, the carriage support and guide subsystems are prone to manufacturing imperfections. One common such imperfection is a lack of straightness. Thus, in existing printers of this type, the carriage has a tendency to make small rotations about a given axis, as it traverses the scan axis; for example its vertical axis, which is often known as the "Z" axis. This has the effect of causing the actual position across the scan axis of the printheads supported in the carriage to vary from their measured positions. This variation may give rise to a systematic error in the position in which ink dots are printed on the print medium. For example, because different coloured printheads are usually spaced apart from one another in the direction of the scan axis, the degree to which each printhead is rotated about the "Z" axis when it passes over a given point in the print zone may be different Where the degree of rotation between printheads is different, inks drops of different colours that should be printed in the same position in an image may be printed in different positions. Where a compound colour is being printed, the result may be a colour that has a hue which varies along the scan axis. This hue shift may give rise to a noticeable print quality defect commonly know as "vertical banding".

It would therefore be desirable to provide a hard copy device and method, which addresses the problems of the prior art

SUMMARY OF THE INVENTION

According to a first aspect of the present invention there is provided an inkjet device having a carriage arranged to support a printhead and to scan across a print zone, the device comprising first and second codestrips traversing the print zone, the device being adapted to generate first and second carriage position information from the first and second codestrips respectively and being further arranged to determine the position along the scan axis of at least part of the printhead from an average of the first and second carriage position information.

By measuring the position of the carriage or printhead relative to the scan axis relative to more than one codestrip, position and orientation information relating to the carriage or printhead may be determined. Thus, the position of a precise location or part of the printhead or carriage may be known relative to the scan axis, for example. Thus, in the event that the orientation of the printhead or carriage alters as it crosses the scan axis, for example due to imperfections associated with the straightness of the scan axis, this may be compensated for. This may be achieved by changing the timing of the firing of the nozzles of the printhead. This technique may help to reduce drop placement errors in the ejected nozzles. In this manner, print defects may be reduced.

In one embodiment, rotation of a printer carriage about its vertical axis (Z axis) is compensated for. In another embodiment, rotation of a printer carriage about its horizontal axis (Y axis), perpendicular to the scan axis, is compensated for. In each of these embodiments first and second codestrips may be used, which are spaced apart in a third axis; the third axis being orthogonal to both the scan axis and the axis about which the rotation to be compensated for occurs.

In one embodiment of the present invention, two codestrips are located spaced apart in the Y axis (the media feed direction), each at a relatively large distance from the printhead. This offers the advantage of avoiding cluttering the generally crowded print zone area with a codestrip. At the same time, by generating an averaged or virtual position of a printhead of the printer, from the two codestrips, the position of the printhead may be accurately determined, even if in the carriage is subject to changes in orientation whilst traversing the scan axis. Conventionally, designers of such systems have attempted to reduce the distance between the codestrip and the printheads. This is because the greater the distance that separates a single codestrip and the printheads, the greater may be the difference in measured and actual position of the printheads when the carriage orientation changes. Consequently, the greater the drop placement error may be. Therefore, the placement of a single codestrip has traditionally been made as close as practicable to the printheads. Thus, it has been a trade off between accepting a degree of drop placement error and design cost. Here the design cost may be in terms of improving the quality of the scan axis in order to reduce imperfections in its straightness for example, and/or attempting to design the print zone to permit the codestrip to be located as close as possible to the prinheads.

In certain embodiments of the invention, one codestrip is located on either side, in the Y axis direction, of the printhead(s). The distance separating each codestrip from the printhead(s) in the Y axis is the same. In this manner, the virtual position signal for the printhead(s) may be a simple average of the signals derived from the two codestrips. This gives rise to the advantage of requiring only a simple computation to determine accurately the position of, for example, the centre of the printhead(s) in the Y axis.

In other embodiments of the invention, the distances separating each codestrip from the printhead(s) may be different. In such embodiments, the virtual position signal for the printhead(s) may be a weighted average of the signals derived from the two codestrips; with the weighting being dependent upon the relative distances that the two codestrips are separated from printheads. This gives rise to the advantage of giving design flexibility to the design of the hard copy device, allowing the relatively unconstrained placement of the codestrips relative to the print zone. It will thus be understood that the average of the first and second carriage position information, be this a weighted, simple or other form of average, may be viewed as a composite of the first and second carriage position information.

In other embodiments of the invention, more than one virtual position signal may be generated from the two codestrips. These may each have a different weighting of the two signals generated from the two codestrips. Unlike single codestrip systems, this gives rise to the advantage of being able to determine the position along the scan axis of two or more points or areas of the carriage or printhead(s) at the same time, where those points occupy different locations in the in the media feed direction. In the case where large printheads are used this may be especially beneficial since even a small rotation of large printhead may cause appreciably different drop placement positions between nozzles in different positions in the printhead(s); and thus appreciable drop placement errors. In this manner, according to such embodiments, the firing of different groups of nozzles or indeed individual nozzles may be independently controlled in dependence upon their detected positions.

The present invention also extends to the method corresponding to the apparatus. Furthermore, the present invention also extends to a computer program and a processor, arranged to implement the method of the present invention. Further aspects of the invention will be apparent from the appended claims.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE INVENTION

There will now be described by way of example only the best mode contemplated by the inventors for carrying out the invention.

First Embodiment

Figure 1A:
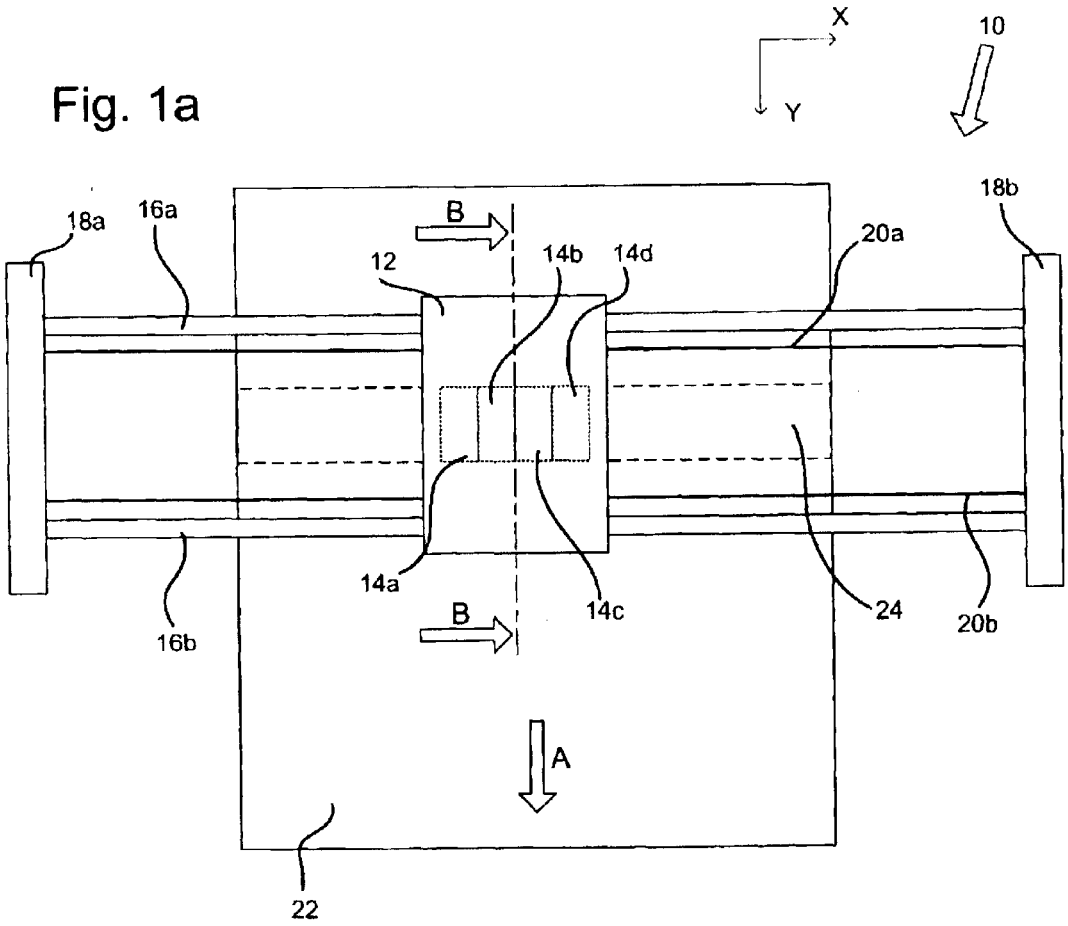
FIG. 1*a* shows a schematic plan view of a large format inkjet printer according to one embodiment of the present invention.

FIG. 1*a* schematically illustrates an inkjet printing mechanism according to a first embodiment of the invention in plan view. In the present example, the inkjet printing mechanism is large format inkjet printer 10, which is suitable for printing conventional engineering and architectural drawings, as well as high quality poster-sized images.

As can be seen from the figure, the printer 10 has a chassis, here represented by two parallel plates 18*a* and 18*b*. Two carriage guide rods 16*a* and 16*b* are supported between the plates 18*a* and 18*b*. The two guide rods 16*a* and 16*b* lie parallel to one another and are aligned with the scanning axis of the printer. This is parallel to the X axis in the figure. The two guide rods 16*a* and 16*b* are arranged to support an inkjet carriage 12. The carriage 12 is arranged to be driven back and forth in a conventional manner along the scanning axis, between the plates 18*a* and 18*b* and in so doing to traverse the print zone 24 of the printer. In the present embodiment, this is achieved using a conventional carriage drive motor (not shown) that propels the carriage 12 in either direction along the guide rods 16*a* and 16*b* in response to control signals received from a conventional printer controller 32, schematically illustrated in FIG. 1*b*.

Figure 1B:
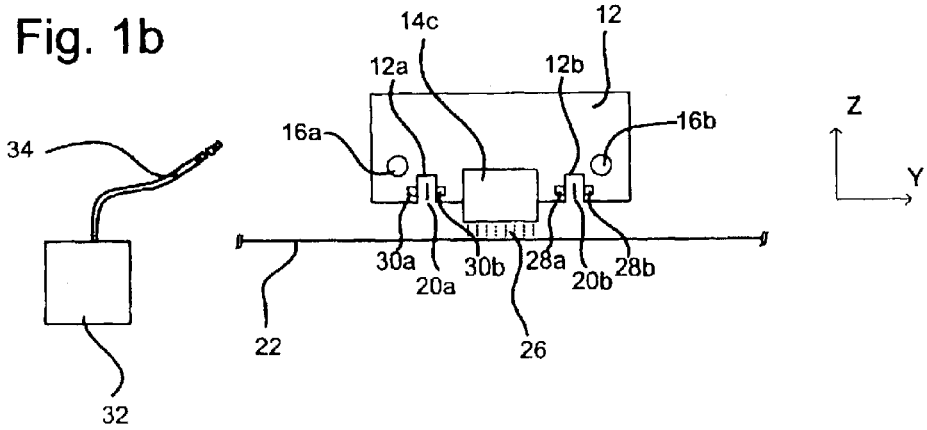
FIG. 1*b* schematically illustrates a cross sectional view of the carriage assembly shown in FIG. 1*a;*

The controller 32 may be a suitably programmed general purpose microprocessor or an ASIC and is arranged to communicate with the various subsystems of the printer 10 and other devices, such as a host device, via one or more conventional communications channels 34; which is also schematically illustrated in FIG. 1*b*.

The printer 10 also includes a conventional print media handling system (not shown) to advance a sheet of print media 22 through the print zone 24. The print media 22 may be any type of suitable material, such as paper, poster board, fabric, transparencies and the like, either in pre-cut sheet form or held in the form of a roll.

In this manner, the controller may control the carriage position in the X axis and the position of the print media in the Y axis such that the inkjet pen supported by the carriage 12 may print at the desired locations on the printing area of the print medium.

Four inkjet printheads 14*a–d* are located in the carriage. Each printhead has an orifice plate with a plurality of nozzles formed therethrough in a manner well known to those skilled in the art. As can be seen from FIG. 1*b*, each printhead is arranged to print drops of ink 26 in a band or swath on the print medium 22 located in the print zone 24. In the present embodiment, the printheads are thermal inkjet printheads, although other types of printheads may be used, such as piezoelectric printheads. In the present embodiment, the printheads 14*a–d* are arranged to print: cyan; magenta; yellow; and black ink, respectively. However, it will be appreciated that in other embodiments of the invention, other numbers of printheads may be employed, which may be arranged to print a greater or smaller number of colours of ink.

In the present embodiment, a conventional "off-axis" ink delivery system is used. By this, it is meant that main stationary reservoirs (not shown) for each ink colour are located in an ink supply region (not shown). Thus, the printheads 14*a–d* may be replenished by ink conveyed through a conventional flexible tubing system (not shown) from the stationary main reservoirs. In this manner, only a small ink supply is propelled by carriage 12 across the print zone 24. It will be appreciated however, that in other embodiments of the invention, an "on-axis" ink delivery system may instead be used.

The printer 10 also includes two codestrips 20*a* and 20*b*. Each of the codestrips 20*a* and 20*b* is supported between the plates 18*a* and 18*b*, using conventional mounting techniques. As can be seen from the figure, each of the codestrips 20*a* and 20*b* is mounted such that it is aligned parallel with the scanning axis of the printer.

Any suitable commercially available codestrips may be used in the present embodiment. Such codestrips are available from PWB-Ruhlatec, Industrial Products GmbH, Siegburger Str. 39c, D-53757 St. Augustin, Germany. In the present embodiment, the codestrips 20*a* and 20*b* have a series of graduations formed on them, arranged perpendicular to the length of the codestrip. Typically, the codestrips are manufactured from a plastics material such as Mylar™ and are formed using a laser plotter by writing equi-spaced, optically readable graduations on the codestrip.

Referring now to FIG. 1*b*, this figure illustrates a cross sectional view of the carriage assembly 12, the guide rods 16*a* and 16*b* and the codestrips 20*a* and 20*b*, taken along the line B—B, as shown in FIG. 1*a*.

As can be seen from the figure, the carriage 12 incorporates two recesses (not referenced) with high precision bearings allowing the guide rods 16*a* and 16*b* to pass through the carriage 12 in a high tolerance sliding fit; in this manner allowing the carriage to be accurately located with respect to the guide rods 16*a* and 16*b* as it moves across the print zone. The carriage 12 also incorporates two further recesses 12*a* and 12*b*. The recesses 12*a* and 12*b* are both schematically illustrated as being located on the lower surface of the carriage as illustrated in the figure and being open to the lower surface of the carriage. The size and position of the recesses 12*a* and 12*b* and the two codestrips 20*a* and 20*b* are selected such that each codestrip passes freely through a corresponding recess as the carriage moves relative to the guide rods 16*a* and 16*b*.

Referring now to the recess 12*b* in the figure, a light source 28*a*, which is typically an LED, is located in one wall of the recess 12*b*. Located in the opposing wall of the recess 12 is a light receiving sensor 28*b*, such as an LDR. The light source 28*a* emits light toward the sensor 28*b*. However, due to relative positions of the light source 28*a*, the sensor 28*b* and the codestrip 20*b*, the light must pass through the codestrip 20*b* in order to be received by the sensor 28*b*. As the carriage moves relative to the stationary codestrip 20*b*, the alternating transparent and opaque regions (graduations) of the codestrip 20*b* cause the light emitted by the light source 28*a* to be alternately sensed and not sensed by the sensor 28*b*. The sensor 28*b* responds to the resulting variations in received light by outputting a correspondingly varying electrical signal. Any suitable sensor system may be used in the present embodiment. One suitable sensor, which combines emitter and received is the HEDS9100 sensor, available from Hewlett Packard Company.

As can be seen from the figure, the recess 12*a* also has associated with it an optical sensor system arranged read the codestrip 20*a* and to output carriage position signals that may be utilised to determine the position of the carriage 12 along the scan axis. The sensor system associated with the recess 12*a* includes a light source 30*a* and a sensor 30*b*, which may be the same as, and operate in the same manner as the light source 28*a* and the sensor 28*b*, and so will not be additionally described. However, it will be understood that the sensor system associated with the recess 12*a* is arranged to read codestrip 20*a* at the same time as the sensor system associated with the recess 12*b* is arranged to read codestrip 20*b*.

Figure 2A:
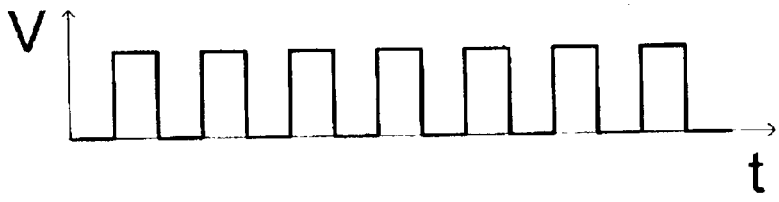
Fig. 2a (Prior Art)
FIG. 2*a* schematically illustrates a conventional carriage position signal.

As is well understood in the art, each sensor system outputs a signal, which from hereon will be referred to as a carriage position signal, which may be used by a printer controller in order to determine the position of the carriage. This may be in the form of a square wave as is schematically illustrated in FIG. 2*a*. In this figure, the high output values, or "ones", correspond to the output of the sensor 28*b* or 30*b* when receiving light emitted by the corresponding light source 28*a* or 30*a*. The low output values, or "zeros", correspond to the output of the sensor 28*b* or 30*b* when the light emitted by the corresponding light source 28*a* or 30*a* is blocked by the opaque parts of the measured codestrip. Commonly, printer carriage position measurement systems employ codestrips having 150 graduations per inch. Thus, the distance between two adjacent rising edge in the signal corresponds to 1/150 inch of travel along the measured codestrip. Thus, the distance between adjacent rising and falling edges in the output signal corresponds to 1/300 inch. As is discussed below, certain techniques are known for further increasing the resolution of measurement of codestrips having a given number of graduations per inch. It will be understood that such techniques may be employed with benefit in this or other embodiments of the invention, however, for the sake of clarity, such techniques will not be described here.

In the case of the present embodiment, two such carriage position signals are simultaneously output to the controller 32; one by sensor 30*b* reading codestrip 20*a* and one by sensor 28*b* reading codestrip 20*b*.

Figure 2B:
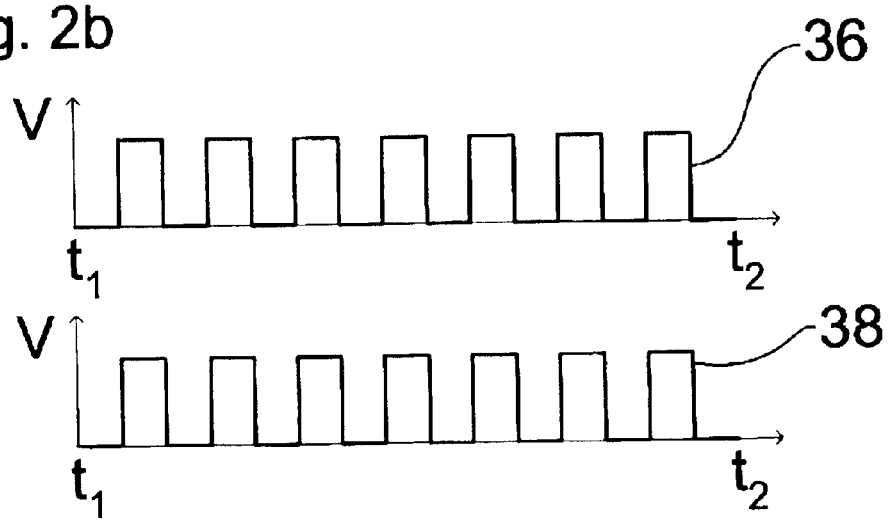
FIGS. 2*b* and 2*c* each schematically illustrate dual carriage position signals generated in one embodiment of the invention.
Figure 3A:
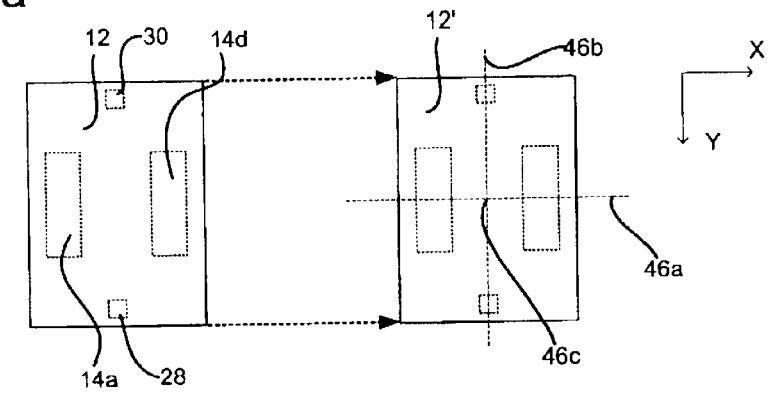
FIG. 3*a* and 3*b* schematically illustrate exemplary paths that the scanning inkjet printer carriage of one embodiment of the invention may follow in traversing the print zone.

If the carriage is driven across the scan axis without rotating about its Z axis, the frequency of the two carriage position signals, that is to say high and low output values, will be the exactly or approximately the same. This situation is illustrated in FIG. 3*a* and FIG. 2*b*. In FIG. 3*a*, the position of the carriage 12 is shown at two instants in time, $t_1$ and $t_2$. At $t_1$, the carriage is labelled 12 and at $t_2$, the carriage is labelled 12'. For the sake of clarity, only the carriage body 12, the printheads 14*a* and 14*d*, and the two sensors 28 and 30 are shown. As can be seen from the figure, between $t_1$ and $t_2$ the carriage 12 has translated along the scan axis, in the direction of the arrows, without rotating in the Z axis. FIG. 2*b* illustrates exemplary carriage position signals 36 and 38 output by the sensors 28 and 30 respectively, between $t_1$ and $t_2$. As can be seen from the figure, the frequencies of the two carriage position signals 36 and 38 match. This indicates that the two sensors 30 and 28 progressed along their respective codestrips at the same speed between and $t_1$ and $t_2$. In practice, there may or may not be a phase difference between the signals 36 and 38.

Generally such scanning carriages rotate in an oscillating manner about the Z axis as they traverse the print zone. Many small rotations about the Z axis, in both rotational senses, may thus occur during each pass over the print zone. In each pass over the print zone, the net rotation of the carriage about the Z axis will be zero or close to zero. Furthermore, the total distance travelled by each of the sensors 28 and 30 relative to their respective codestrips will be exactly or substantially the same. However, whilst the carriage is rotating in one direction about its Z axis, whilst being driven across the scan axis, one of the sensors 28, 30 may travel faster along its respective codestrip than the other and therefore may travel further in a given time. Thus, during that given time it may output a carriage position signal at a higher frequency than the other. When the carriage rotates back in the reverse direction, the opposite may be true.

Figure 2C:
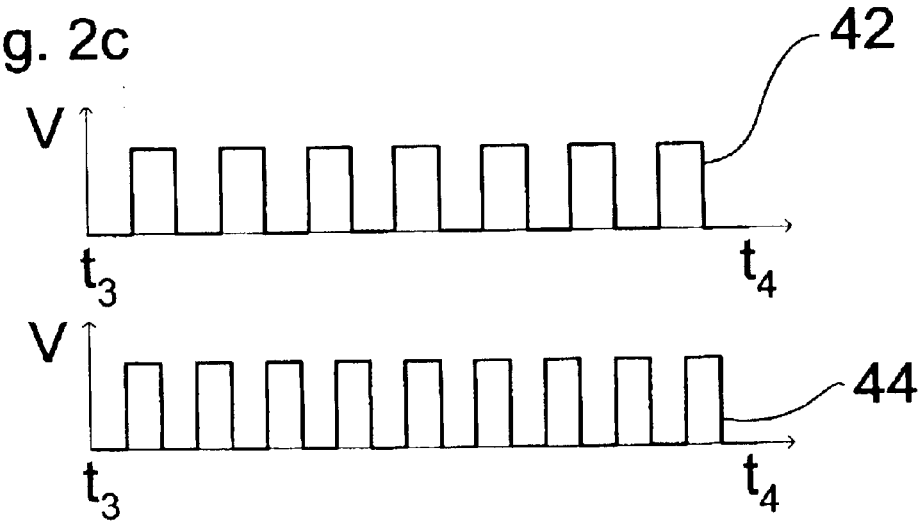
Figure 3B:
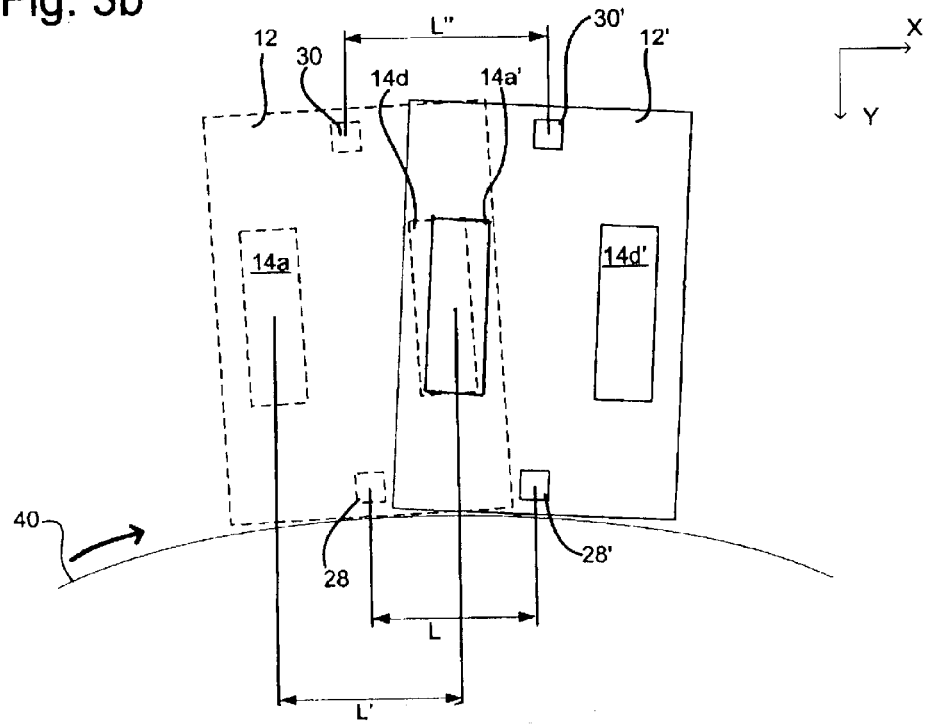

This process is illustrated in FIG. 3*b* and FIG. 2*c*. FIG. 3*b* illustrates, in a highly exaggerated manner, a curved path followed by the carriage 12, which causes the rotation of the carriage. The curved path is illustrated by the curved line 40, and direction of movement of the carriage along the path 40 (clockwise as viewed in the figure is indicated by the arrow. Like FIG. 3*a*, FIG. 3*b* illustrates the position of the carriage 12 at two instants in time, $t_3$ and $t_4$. The carriage 12 and printheads 14*a* and 14*d* are shown with primed references, i.e. 12', 14*a*' and 14*d*', at $t_4$, and with unprimed references, i.e. 12, 14*a* and 14*d*, at $t_3$. For the purposes of clarity, the views of the carriage 12 are enlarged in FIG. 3*a* relative to FIG. 2*a*. Also for the sake of clarity, the carriage body 12, the printheads 14*a* and 14*d*, and the two sensors 30 and 28 are shown in dotted line at $t_3$ and in full line at $t_4$.

As can be seen from FIG. 3*b*, the location along the scan axis of the printhead 14*d* at $t_3$ is approximately the same that of the printhead 14*a*' at $t_4$. However, due to the rotation of the carriage, the position of the printhead 14*a*' at $t_4$ does not exactly overlie the position of the printhead 14*d* at $t_3$. In this example, the sensor 30 travels further during this period than does the sensor 28. The distances travelled by the sensors 30 and 28 in this period are referenced in the figure L" and L, respectively. Thus, the frequency of the carriage position signal output by sensor 30 during this period is greater than that output by sensor 28. This is illustrated in FIG. 2*c*, which illustrates exemplary carriage position signals 42 and 44 output by the sensors 28 and 30 respectively, between $t_3$ and $t_4$.

The distance travelled by the printheads, for example printhead 14*a*, in the same time period is referenced in the figure L'. It will be appreciated that L' is greater than L and less than L", since the printheads lie at an intermediate distance from the centre of rotation of the printer carriage in relation to the two sensors 28 and 30. The distance L' actually corresponds to the distance travelled by the centre, in the Y axis, of the printhead 14*a*. It will in fact be appreciated that different areas of each printhead will travel different distances relative to each other when the carriage rotates about its Z axis However, the se differences will be small in comparison to the differences between the distances travelled between either of the sensors 28, 30 and any part of the printhead. This is because generally, a sensor such as 28 or 30 will be offset from the printheads in the Y direction by a relatively large distance; for example 160 millimetres. It will be noted that the figures, such as FIG. 3*b* are not drawn to scale.

During a given pass by the carriage over the print zone, the controller counts the pulses (or changes in state between high and low) for each of the carriage position signals output by the two sensors 28 and 30. This yields two cumulative totals. The first of these $T_1$ corresponds to the cumulative pulse total outputted during that pass by the sensor 28. The second of these $T_2$ corresponds to the cumulative pulse total outputted during that pass by the sensor 30. Either of these cumulative totals $T_1$ or $T_2$ would thus enable a conventional scanning inkjet printer controller to determine the position and velocity of the associated sensor 28 or 30 relative to its respective codestrip using a conventional process. In the present embodiment of the invention, however, the controller repeatedly averages totals $T_1$ or $T_2$, to yield a composite total $T_3$. The composite total $T_3$ is then used as a "virtual carriage position signal".

The composite total $T_3$ may be generated in a number of ways. However, in the present embodiment each of the signals $T_1$ or $T_2$ is sampled at a rate significantly higher than the change rate of those signals. Whenever, either of the signals $T_1$ or $T_2$ is determined to have changed state, the current binary totals of the two signals are summed. The binary summed value is then divided by two. When the divided value yields a whole number, but not when the divided value yields a fraction, the composite total $T_3$ is updated to equal the divided value. In this way, the positional resolution of the virtual carriage position signal may be made to equal the carriage position signals output by the two sensors 28 and 30.

This virtual carriage position signal is used to determine the velocity and position along the scan axis of a point 46*c* located on the carnage 12; which is illustrated on carriage 12' in FIG. 3*a*. The determination of velocity and position of point 46*c* may, using the composite total $T_3$, then be made in using a conventional process, as mentioned above.

By carrying out a simple averaging of the totals $T_1$ and $T_2$, to generate the total $T_3$, it will be understood that the point 46*c* will be located midway between the two sensors 28 and 30. In the present embodiment, the printheads 14*a–d* are located side by side in the carriage 12 and arranged so as to be collectively symmetrical about both an X and a Y axis in the carriage. These axes are respectively referenced 46*a* and 46*b* in FIG. 3*a*. Furthermore, in the present embodiment, the position of the two sensors 28 and 30 are selected such that their mid-point 46*c* coincides with the point of intersection of the X and Y carriage axes. Thus, it will be appreciated that virtual carriage position signal may be used to determine the velocity and position of the central point in the X-Y plane of the four printheads 14*a–d*; or in the centre of the nozzle plate of the printer. The virtual carriage position signal may then be used to drive the firing timing of the printheads. In this manner, the inaccuracy in drop placement caused as a result of the carriage rotating about its Z axis may be reduced since, in the present embodiment, this position error is not magnified by the distance between the codestrip and sensor combination and the printheads. Furthermore, in the present embodiment, this may be done without the need for locating a codestrip and sensor in the crowded central part of the carriage.

Second Embodiment

The second embodiment of the present invention generally employs the same apparatus and generally operates in the same manner as described with reference to the first embodiment. Therefore, similar apparatus and methods of operation will not be described further. Additionally, similar components are illustrated and numbered in the same manner as is the case in the earlier embodiment.

In the second embodiment of the invention, instead of generating a single virtual carriage position signal from the carriage position signals output by the two sensors 28 and 30, multiple virtual carriage position signals are generated. In this way different weighted averages of the carriage position signals output by the two sensors 28 and 30 may be generated and used to determine the firing timing of different groups of ink ejection nozzles in the printheads.

Figure 4A:
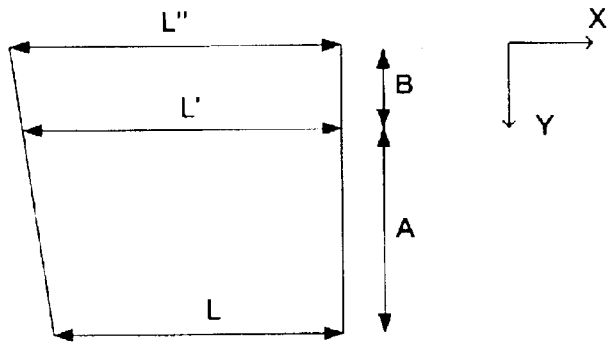
FIG. 4*a* schematically illustrates how a given point on the printer carriage of one embodiment of the invention may be displaced relative to two carriage mounted sensors, for a given degree of rotation of the carriage about the Z axis; and, FIG. 4*b* schematically illustrates the nozzle layout and position in the Y axis of an exemplary printhead of an embodiment of the invention relative to two carriage mounted sensors.

Referring to FIG. 4*a*, this embodiment will now be described. FIG. 4*a* schematically illustrates how a given point on the printer carriage 12 is displaced relative to the two sensors 28 and 30, for a given degree of rotation of the carriage about the Z axis.

Line L represents the displacement or position of the sensor 28 relative to its respective codestrip at a given time. Line L" represents the displacement or position of the sensor 30 relative to its respective codestrip at the same time. As can be seen from the figure, at this point in time, the distance L" is greater than L, as a result of carriage rotation about the Z axis. The position along the scan axis of a location associated with the carriage 12, such as a given nozzle of a given printheads may be determined by knowing its relative position relative to the sensors 28 and 30. For example, a postion $P_0$, lies a distance B in the media feed direction (i.e. along the axis 46*b* shown in FIG. 3*c*) from sensor 28 and a distance A in the media feed direction (i.e. along the axis 46*b* shown in FIG. 3*c*) from sensor 30. As can be seen from FIG. 4*a*, the distance or position L' of $P_0$ along the scan axis, relative to that of the two sensors is dependent upon the relative magnitude of distances A and B. Specifically, $$L'=((L*B)+(L''*A))/(A+B) \qquad \text{equation 1}$$

Figure 4B:
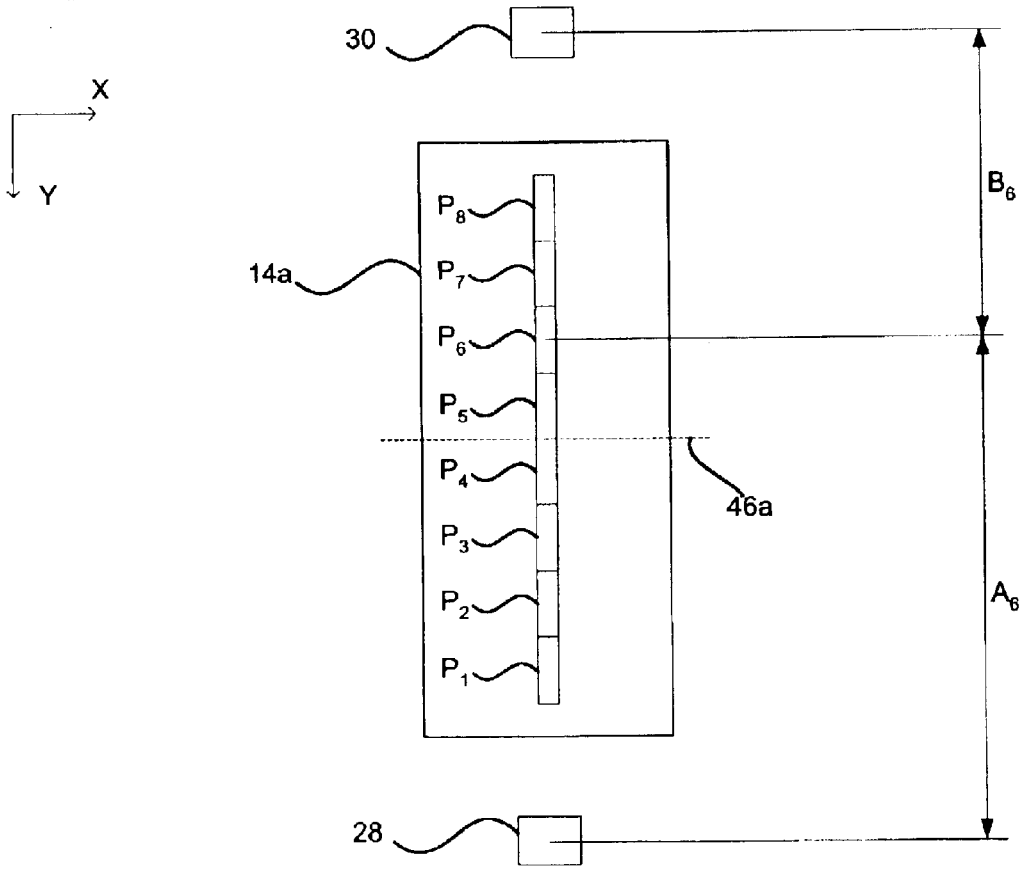

Referring now to FIG. 4*b*, one of the printheads, for example printhead 14*a*, of the present embodiment is illustrated. This figure illustrates in simplified plan view the nozzle layout of the printhead whilst located in the carriage 12. Also illustrated in the figure are the two sensors 28 and 30, indicating the relative positions of the two sensors 28 and 30 and the nozzles of the printhead in the Y axis.

The printhead in this example has a single array of nozzles, which is aligned parallel to the Y axis. The array is composed of 8 conventional primitives, or groups of nozzles. In the figure the primitives are referenced $P_1$–$P_8$. Each primitive $P_1$–$P_8$ is separated from each of the sensors 28 and 30 by a known distance in the Y axis. For example, the centre of the primitive $P_6$, in the Y axis, lies a known distance $A_6$ in the Y axis from sensor 28. Similarly, the centre of the primitive $P_8$, in the Y axis, lies a known distance $B_6$ in the Y axis from sensor 30.

Thus, in the case of the nozzles of the primitive $P_6$, a virtual carriage position signal may be calculated using equation 1; where the distance $L'(P_6)$ of the primitive $P_6$ along the scan axis, relative to that of the two sensors is equal to:

$$L'(P_6)=((L*B_6)+(L''*A_6))/(A_6+B_6) \qquad \text{equation 2}$$

By repeatedly calculating the value of $L'(P_6)$ as the carriage traverses the scan axis, as described in respect of the first embodiment, a virtual position signal may be generated for the position of this primitive. A virtual position signal for each of the remaining primitives may be calculated in the same manner. In this way, the print controller may determine the position of each primitive across the scan axis and use this data to more accurately control the firing timing of each primitive to compensate for the rotation of the carriage about its Z axis.

As is well understood in the art of inkjet printing, all of the nozzles of a given primitive are generally driven as a group. Nozzles of different primitives may fire simultaneously, however, generally only one nozzle per primitive is fired at a time. This is controlled as a fixed firing order at a determined firing frequency. Thus, the size and number of primitives in a printhead is a trade off between the requirements for increased scan speeds and for reduced peak power consumption of a printing system. Commonly, however, a printhead may have 8 or more primitives, each making up a fraction of the swath width of the printhead. Generally, therefore, each primitive has a "length" in the media feed axis of a small fraction of an inch. This means that by generating a virtual position signal for each primitive of each printhead, in the present embodiment, any error in the placement of drops ejected by that primitive, which may occur as a result of rotation of the carriage about the Z axis, will be comparatively small. At the same time, however, the computational power required to generate and employ the required number of virtual position signals need not be impracticable.

In the above described embodiments, the locations of either end of each codestrip in the scan axis may be measured in any conventional manner. This data may be stored in the printer operating system such that the controller is able to relate a position along the scan axis read from one codestrip with that read from the other codestrip; i.e. the controller may relate the position along the scan axis of given graduation of one codestrip to a corresponding graduation of the other codestrip. Preferably, the printer system is set up to so that a line printed perpendicular to the scan axis that is greater than the swath width of the pens should appear to be "continuous" and without jaggedness. That is to say that the abutting ends of portions of the line printed before and after media feed operations are not displaced from one another in the scan axis direction. By varying the relationship, or correspondence between the graduations of the two codestrips, such lines may be printed with varying degrees of jaggedness. In this way, various such lines that form a test pattern, may be printed with each line being printed using a different correspondence between the graduations of the two codestrips. A user may simply select the line that appears most continuous in order that the printer system can set the correspondence between the graduations of the two codestrips.

Further Embodiments

In the above description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, the skilled reader will appreciate that although the above embodiments were described with reference to a wide format inkjet printer, it will be understood that the present invention may be applied to a wide range of devices where position information is derived from a codestrip. These may include desk-top inkjet printers, non-inkjet printers, copiers, and facsimile machines and scanners to name but a few.

It will be appreciated that in an alternative embodiment to the first embodiment described above, a weighted average could be employed, as is described in the second embodiment described above. It will be appreciated that this may allow more design freedom in terms of the placement of the various printer system components, such as codestrips etc.

In the above described embodiments, the codestrips are arranged such that they are not mutually offset in the direction of the scan axis. However, in other embodiments the codestrips may be mutually offset in the direction of the scan axis. Such a technique may be used to provide a wider print zone than is normally possible whilst using codestrips of conventional length. Such techniques are more fully described in co-pending U.S. patent application, Ser. No. 6,399,985, filed on Jun. 4, 2002, titled "POSITION MEASUREMENT SYSTEM AND METHOD," which is hereby incorporated in its entirety into the present specification.

As was described above, codestrip sensors generally output two signals; a first or "A" signal and a second or "B" signal, which is 90 degrees out of phase with but otherwise similar to the "A" signal. The presence of the second signal allows the printer controller to determine changes in the direction of travel of the carriage. In certain prior art applications, the "A" and "B" signals of the standard optical sensors are XORed together. This effectively doubles the output resolution of the sensor to 600 dpi. It will be apparent to the skilled reader that this technique may be employed with benefit in embodiments of the present invention.

Although two guide rods are used in the above-described embodiments, the skilled reader will appreciate that this need not be the case in other embodiments of the invention. The presence of two guide rods may be of assistance in embodiments where extra strength, rigidity or precision is required in the scan axis. For example, where the scanning carriage is comparatively massive and/or large. It will thus be appreciated that other embodiments of the present invention use only one guide rod or other guide device. Furthermore, in other embodiments of the invention, three or more guide rods or other guide devices could be employed.

In other embodiments of the invention, different numbers of virtual position signals may be generated and used to control the firing timing of different numbers of primitives, or groups of nozzles. In one set of such embodiments, less virtual position signals may be used than there are primitives in a given printhead. Thus, two, three, four or more virtual position signals could be generated, each to control the firing timing of one half, one third, one quarter, or a higher fraction of the total number of primitives in one ore more printheads. An advantage of such an embodiment is that it may require less computational power to generate and employ the required number of virtual position signals than was required in the second embodiment, whilst providing improved dot placement error correction caused by rotation of the carriage about its Z axis than the first embodiment. In another set of such embodiments, more virtual position signals may be used than there are primitives in a given printhead. In one such embodiment, a different virtual position signal could be used to control the firing timing of each nozzle in a given printhead. Such an embodiment may require greater computational power to generate and employ the required number of virtual position signals. However, it may provide improved dot placement error correction caused by rotation of the carriage about its Z axis.

In another embodiment of the invention, a further codestrip/sensor pair is employed. In this embodiment, the further codestrip may be located parallel to the other codestrips but at a different height in the Z axis. In this manner, any rotation which the carriage makes about the Y axis (resulting in different printheads rotating to different distances from the plane of the print medium) may be measured. In this embodiment, the firing timing of primitives or nozzles may also be modified to correct for this rotation in the same way as described above, with regard to rotation about the Z axis. It will also be apparent to the skilled reader that as a modification to this embodiment, correction to rotation about the Y axis only may be provided.

In the above-described embodiments one codestrip/sensor pair is arranged on either side of the printheads in the Y axis. Thus, the virtual position signal may be seen as being derived by interpolation. It will be appreciated, however, that in other embodiments, two codestrip/sensor pairs may be located on the same side, in the Y axis, of the printheads. By arranging each codestrip/sensor pair at a different distance in the Y axis from the printheads, one or more virtual position signals may be generated as explained above, allowing the position along the scan axis of part of a printhead to be accurately determined. Thus, in such an embodiment, the virtual position signal may be seen as being derived by extrapolation.

Although in the above described embodiments the sensors used are optical sensors, the skilled reader will appreciate that in practice any suitable sensor, such as magnetic sensors, may instead be used.

What is claimed is:

1. An inkjet device having a carriage arranged to support a printhead and to scan across a print zone, the device comprising first and second codestrips traversing the print zone, the device being adapted to generate first and second carriage position information from the first and second codestrips respectively and being further arranged to determine the position along the scan axis of at least part of the printhead from an average of the first and second carriage position information.

2. A device according to claim 1, wherein the device is adapted to control the timing of the firing of one or more ink ejection nozzles of the printhead in dependence upon the determined position.

3. A device according to claim 2, wherein the device is arranged to determine the position along the scan axis of a plurality of locations of the printhead from differently weighted averages of the first and second carriage position information, such that the timing of the firing two or more groups of ink ejection nozzles may be controlled differently.

4. A device according to claim 3, wherein one of the two or more groups of ink ejection nozzles comprise one or more primitives.

5. A device according to claim 3, wherein one of the two or more groups of ink ejection nozzles comprises a fraction of a primitive.

6. A device according to claim 5, wherein one of the two or more groups of ink ejection nozzles comprises an individual nozzle.

7. A device according to claim 1, wherein said carriage supports first and second codestrip readers arranged to read the first and second codestrips respectively.

8. A device according to claim 7, wherein first and second codestrip readers are located at substantially different distances from said at least part of the printhead in the Y axis.

9. A device according to claim 8, wherein the average of the first and second carriage position information is a weighted in dependence upon the relative distances of the first and second codestrip readers from said at least part of the printhead in the Y axis.

10. A device according to claim 9, wherein the calculated position L' along the scan axis of at least part of the printhead is substantially equal to:

$$L'=((L*B)+(L''*A))/(A+B)$$

where, L and L" respectively correspond to the first and second carriage position information and A and B respectively correspond to respective distances in the Y axis of the first and second codestrip readers from said at least part of the printhead.

11. A device according to claim 7, wherein first and second codestrip readers are located at substantially different distances from said at least part of the printhead in the Z axis.

12. A device according to claim 11, wherein the average of the first and second carriage position information is a weighted in dependence upon the relative distances of the first and second codestrip readers from said at least part of the printhead in the Y axis.

13. A device according to claim 12, wherein the calculated position L' along the scan axis of at least part of the printhead is substantially equal to:

$$L'=((L*B)+(L''*A)/(A+B)$$

where, L and L" respectively correspond to the first and second carriage position information and A and B respectively correspond to respective distances in the Z axis of the first and second codestrip readers from said at least part of the printhead.

14. A hard copy device having a carriage arranged to support a printhead and to reciprocate across a scan axis, the device being arranged to determine the position of the printhead along the scan axis, compensating for carriage rotation about a second axis, by interpolating or extrapolating from carriage position information derived from first and second codestrips traversing the scan axis and mutually spaced apart in third axis, where the scan, first and second axes are mutually orthogonal.

15. In a scanning printer, a method for determining the position of a printhead along a scan axis, comprising the steps of:

simultaneously, generating first and second position information from first and second codestrips respectively, the first and second codestrips being differently spaced from the printhead in an axis orthogonal to the scan axis;

determining the position of at least part of the printhead from a weighted average of the first and second carriage position information.

16. A method according to claim 15, wherein the average is weighted in dependence upon the relative distances of the first and second codestrip readers from said at least part of the printhead in the orthogonal axis.

17. A method according to claim 16, wherein the average is an extrapolation.

18. A method according to claim 16, wherein the average is an interpolation.

19. A method according to claim 16, further comprising the step of controlling the timing of the firing of one or more ink ejection nozzles of the printhead independence upon the determined position.

20. A method according to claim 19, further comprising the steps of:

determining the position along the scan axis of a plurality of locations of the printhead from differently weighted averages of the first and second carriage position information; and, controlling independently the timing of the firing of the two or more groups of ink ejection nozzles.

21. A computer program comprising program code means for performing the method steps of claim 15 when the program is run on a computer and/or other processing means associated with suitable apparatus.

22. A computer program product comprising program code means for performing the method steps of claim 15 when the program is run on a computer and/or other processing means associated with suitable apparatus.

23. A processor device for performing the method steps of claim 15 when associated with suitable apparatus.

* * * * *